US006041919A

United States Patent [19]

Adams

[11] Patent Number: 6,041,919

[45] Date of Patent: Mar. 28, 2000

[54] LID AND LID SYSTEM FOR STORING AN IMPLEMENT IN A CONTAINER

[75] Inventor: Robert W. Adams, Redondo Beach, Calif.

[73] Assignee: Brushwiser Corporation, Redondo Beach, Calif.

[21] Appl. No.: 09/221,105

[22] Filed: Dec. 23, 1998

Related U.S. Application Data

[63] Continuation-in-part of application No. 08/899,436, Jul. 24, 1997, abandoned.

[51] Int. Cl.[7] ..... A45D 44/18

[52] U.S. Cl. ..... 206/15.3; 206/15.2; 206/362.3; 220/736

[58] Field of Search ..... 206/15.2, 15.3, 206/362, 362.3; 220/229, 736; 15/257.05; 401/127, 129

[56] References Cited

U.S. PATENT DOCUMENTS

| | | | |
|---|---|---|---|
| 851,443 | 4/1907 | Schmidt | 206/15.3 |
| 2,262,753 | 11/1941 | Brennen | 206/15.1 |
| 2,436,291 | 2/1948 | Daniel | 15/257.05 |
| 2,533,355 | 12/1950 | Comfort | 211/65 |
| 3,262,556 | 7/1966 | Morrison . | |
| 3,291,295 | 12/1966 | Caligiuri | 206/15.3 |
| 3,603,551 | 9/1971 | Peterson . | |
| 3,955,670 | 5/1976 | Buslik | 206/15.3 |
| 4,533,044 | 8/1985 | Ban | 206/362 |
| 4,948,009 | 8/1990 | Sawatani | 220/229 |
| 5,007,553 | 4/1991 | Curtis | 206/15.3 |
| 5,025,947 | 6/1991 | Leone | 220/229 |
| 5,092,463 | 3/1992 | Dees | 206/373 |
| 5,363,870 | 11/1994 | Doyon | 206/15.3 |
| 5,409,126 | 4/1995 | DeMars | 220/4.27 |
| 5,484,065 | 1/1996 | Davoli, Jr. et al. | 220/736 |
| 5,540,363 | 7/1996 | Wilson | 206/15.3 |
| 5,599,125 | 2/1997 | Vasas et al. | 401/129 |

*Primary Examiner*—David T. Fidei
*Attorney, Agent, or Firm*—Jeffer Mangels, Butler & Marmaro LLP

[57] ABSTRACT

A lid for a container having a spreadable fluid therein. The lid includes a less resilient portion having at least one hole defined therethrough and at least one more resilient portion overlapping the at least one hole of the less resilient portion. The more resilient portion has at least one slit grouping in registration with the at least one hole of the less resilient portion. The at least one slit grouping perforates the more resilient material.

5 Claims, 6 Drawing Sheets

LID AND LID SYSTEM FOR STORING AN IMPLEMENT IN A CONTAINER

This is a continuation-in-part of U.S. patent application Ser. No. 08/899,436 filed Jul. 24, 1997, now abandoned, the disclosure of which is incorporated in its entirety herein by reference.

FIELD OF THE INVENTION

The present invention relates to an apparatus for storing an applicator or applicators for applying surface coatings and the like in a container containing a volume of the liquid coating, particularly painting applicators to be stored in a standard size paint can.

BACKGROUND OF THE INVENTION

Paint brush maintenance can often be a time consuming and difficult process. If a brush is left uncleaned after use, the paint thereon often hardens, thereby rendering the brush useless. Typically a brush is cleaned using a solvent or the like. However, solvents can be expensive and noxious to the person using the solvent. Solvents can also be harmful to the environment as a result of evaporation of the solvent and disposal of the solvent in sinks, storm drains and the like and is illegal in many jurisdictions.

When cleaning a brush by hand the bristles of the brush are often bent and/or pulled out of the brush altogether. Repeated cleanings of the same brush can be very harmful to the bristles, as solvents can cause the bristles to deteriorate.

Apparatus for retaining a painting implement, such as a paint brush, in various types of cans and containers are known in the art. For example, U.S. Pat. No. 4,533,044 discloses a storage container for paint applicators which uses a lid having openings, and which the lid also includes additional protruding seals and requires use of clasps affixed to the paint applicator handles to prevent slippage into the separate storage container. U.S. Pat. No. 3,955,670 discloses a paint brush holder which includes a lid having a spring clip for holding a paint brush in a can. U.S. Pat. No. 3,291,295 discloses a paint container and brush holder which uses a two-piece hinged mechanism to retain a paint brush handle so that a paint brush can be stored in a paint container. However, these types of brush holders have not proved effective in minimizing the need for brush maintenance and cleaning.

Accordingly, it would be desirable to provide a lid which would fit containers that a consumer already has (i.e., the container does not have to be provided with the lid), particularly paint cans in which paint is commonly sold, and which lid could be easily and cheaply manufactured, having simple, easily used means of retaining an implement when the lid is affixed to the paint can, while insuring that the contents of the container remain useable, for example, that paint in the paint can does not dry out before the paint would be typically used. Additionally, it would be desirable to provide a lid such as that described above that minimizes or even eliminates the need for cleaning solvents.

SUMMARY OF THE INVENTION

In accordance with one aspect of the present invention, there is provided a lid for a container having a spreadable fluid therein. It will be understood that such fluids include liquids, gels, powders and the like. The lid includes a less resilient portion having at least one hole defined therethrough and at least one more resilient portion overlapping the at least one hole of the less resilient portion. The more resilient portion has at least one slit grouping in registration with the at least one hole of the less resilient portion. The at least one slit grouping perforates the more resilient material.

In accordance with another aspect of the present invention, there is provided a system for holding brushes in a container for containing a spreadable fluid therein. The system includes a container having a spreadable fluid therein, a lid having at least one hole defined therethrough for the container, and a piece of material connected to the lid. The piece of material has a slit grouping that perforates the piece of material and the slit grouping is brought into opposing correspondence with a lid hole. The slit grouping comprises at least two slits that intersect at a common point.

In accordance with another aspect of the present invention, there is provided a lid for suspending implements in a container for containing a spreadable fluid therein. The lid includes a rim snugly engageable with the container with two diametrically opposed container engaging portions. The lid also includes a central portion circumscribed by and formed as a unit with the rim. The central portion has at least one opening defined therein for receiving and suspending the implement. The central portion defines a first vertical height, and when in an inverted position the central portion defines a second vertical height that is different than the first vertical height for suspending the implement at different heights within the container.

In accordance with a further aspect of the present invention, there is provided a resilient insert to be secured in registration with an opening defined in a lid for suspending an implement in suspension in a container for containing a spreadable fluid. The resilient insert includes at least one slit grouping defined therethrough for receiving and retaining a portion of an implement within the container at some portion of the longitudinal length thereof.

In accordance with a further aspect of the present invention, there is provided a lid for suspending implements in a container for containing a spreadable fluid therein The lid includes a rim snugly engageable with the container and a central portion circumscribed by the rim. The central portion has at least one opening defined therein for receiving and suspending the implement. The rim also includes a resilient insert having at least one slit grouping defined therethrough for receiving and retaining a portion of the implement within the container. The resilient insert is secured in registration with the at least one opening in the central portion.

In accordance with a further aspect of the present invention, there is provided a kit including a lid for retaining implements in a container for containing a spreadable fluid therein, a brush retention member, and a brush. The lid includes a rim snugly engageable with the container and a central portion circumscribed by the rim. The central portion has at least one opening defined therein for receiving and suspending the implement and the at least one opening is at least partially surrounded by an indented portion. The brush retention member is adapted to engage the lid and has an opening defined therethrough that has a resilient insert secured therein. The resilient insert has a resiliently expandable opening defined therein for receiving a handle of a brush at some portion of the longitudinal extent thereof. The brush retention member is adapted to at least partially correspond to the indented portion.

Other features and advantages of the invention will become apparent from the following detailed description, taken in conjunction with the accompanying drawings which illustrate, by way of example, various features of preferred embodiments of the invention.

DESCRIPTION OF THE FIGURES

The detailed description of the invention will be made with reference to the accompanying drawings, where like numerals designate corresponding parts of the figures. The drawings are meant to be generally illustrative of various examples of the present invention, but are merely examples and are not meant to be limiting of the scope of the invention.

Like numerals refer to like parts throughout the several views of the drawings.

DETAILED DESCRIPTION OF THE INVENTION

Figure 1:
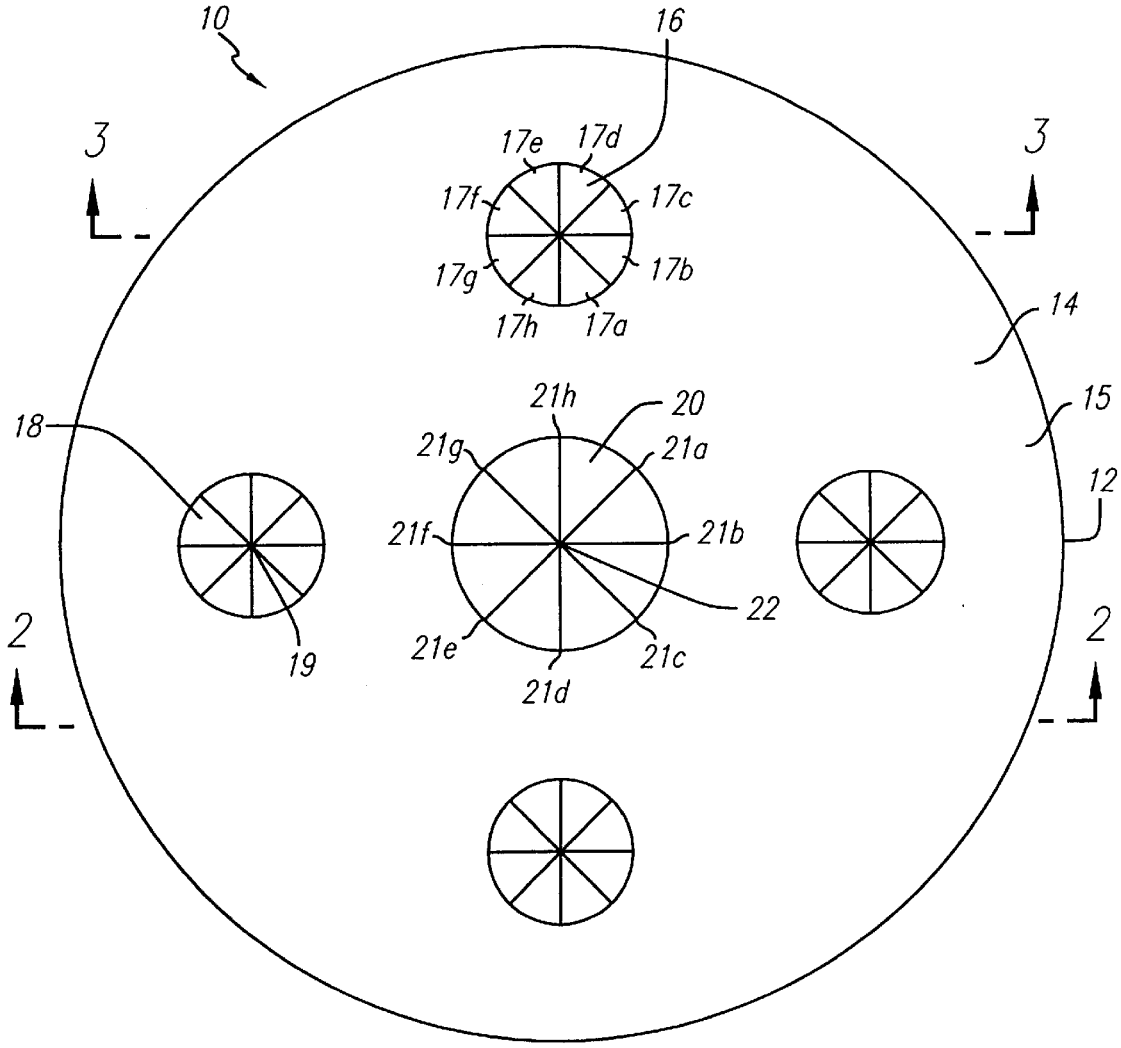
FIG. 1 is a top view illustrating one embodiment of a lid of the invention including a number of openings formed in the lid.
Figure 2:
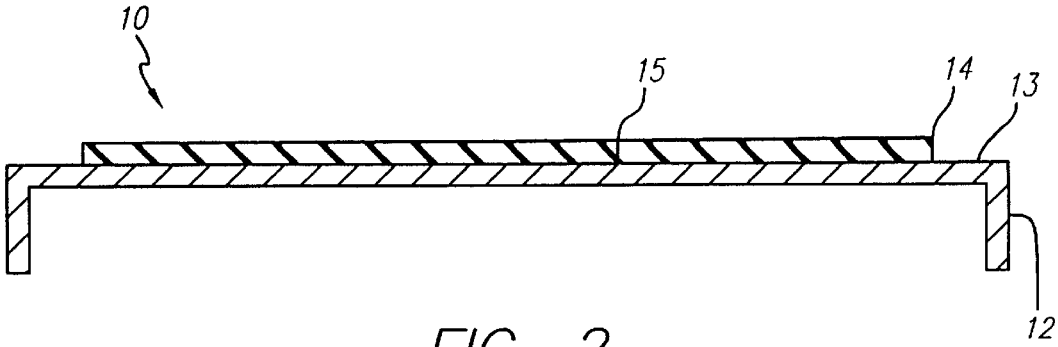
FIG. 2 is a cross-sectional view through line 2—2 of FIG. 1 illustrating a lid of the present invention.
Figure 3:
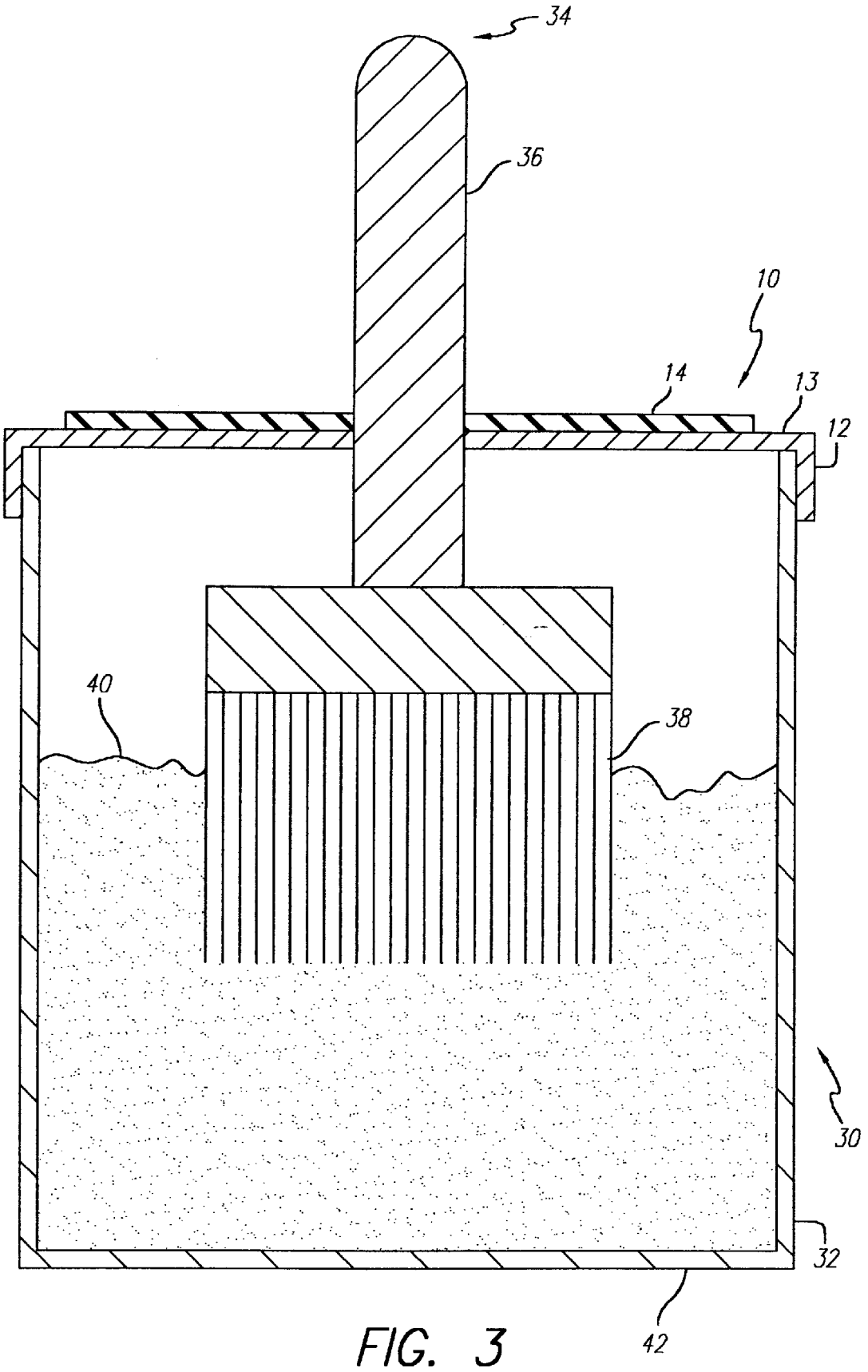
FIG. 3 is a cross-sectional view through line 3—3 of FIG. 1 illustrating a system of the present invention which includes a standard size container, a paint can, and a lid of the present invention affixed thereto illustrating an implement, a paint brush, retained by the lid.
Figure 4:
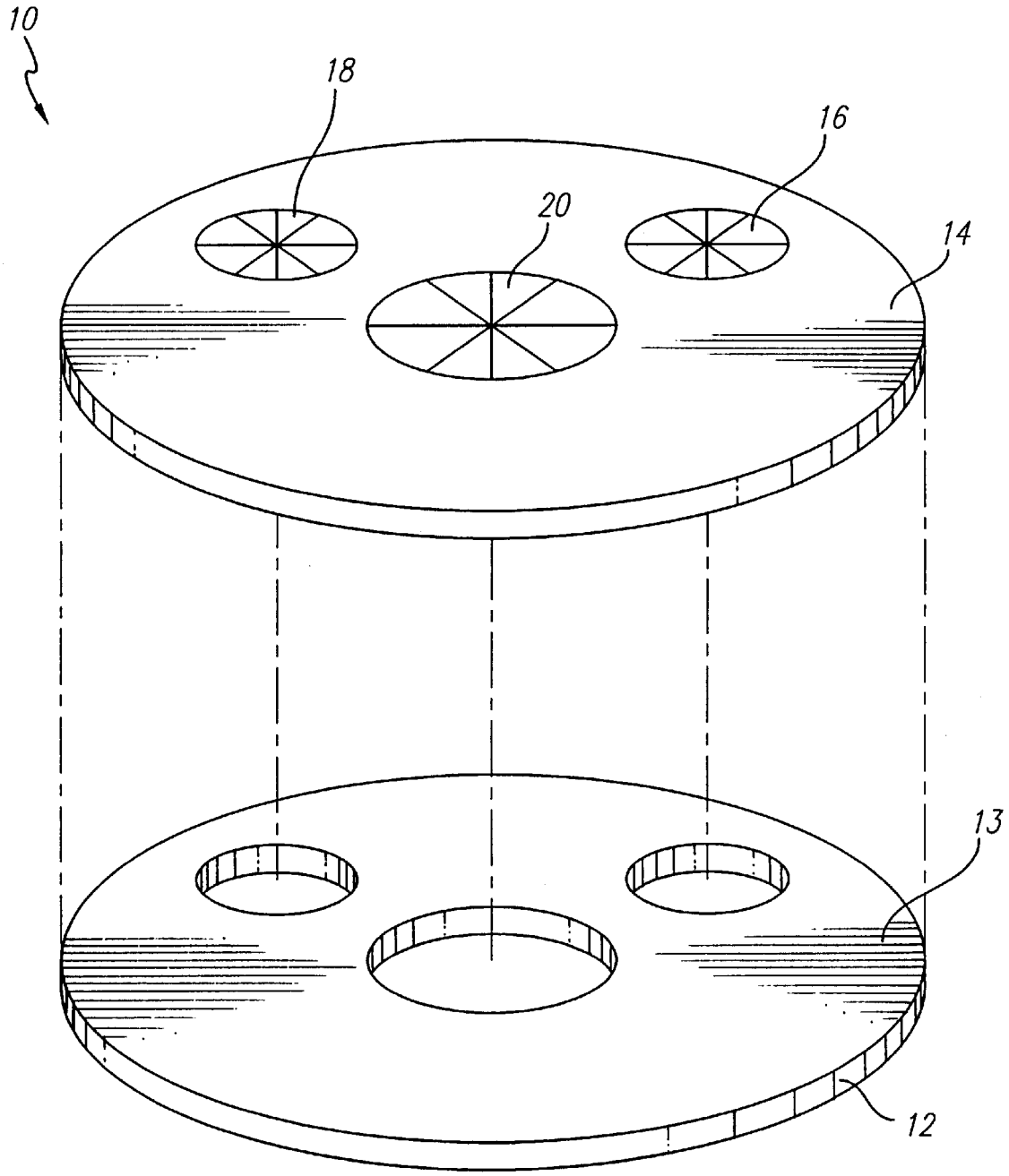
FIG. 4 is an exploded view of a lid of the invention showing the registration of the openings in the resilient material with the openings of the central portion.

Turning now to the figures, FIGS. 1–3 depict a container lid 10 which can be fitted over a standard sized container 32 for storing an implement or implements in therein. In a preferred embodiment, the implement is a brush 34 stored in a paint can. Storing the brush 34 in this manner preserves and in some instances restores the brush 34 for longer use and easier maintenance. Lid 10 includes an integral rim 12 which is snugly engageable with standard sized container 32. Lid 10 can include a central portion 13. Preferably, a resilient material 14 is affixed adjacent central portion 13 in at least a part 15 of central portion 13 of lid 10. In a preferred embodiment, lid 10 is formed of plastic and most preferably is a standardly manufactured lid. Lid 10 can be formed from, for example, low-density polyethylene. In one embodiment, lid 10 includes at least two holes, resilient material 14, preferably rubber, overlaps lid 10 and includes radial slit groupings, described below, which are in registration with the holes in lid 10. In another embodiment, resilient material 14 can be disposed over only a hole and a portion of lid 10 immediately surrounding the hole. Resilient material 14 is more preferably silicone rubber. Resilient material 14 can be affixed to lid 10 by an adhesive or by mechanical means such as rivets, staples, ultra-sonic welding, stitches, such as threaded stitches, shut-offs or protrusion/spike arrangements (described below) and combinations thereof.

Lid 10 is preferably sized to fit standard size containers, preferably cans and most preferably paint cans. For example, 1 quart, 1 gallon, 2 gallon and 5 gallon paint cans may be used with the lid system of the present invention. However, lid 10 can be manufactured to fit any size or shape container, can or paint can. Lid 10 is preferably circular in perimeter, as most standard containers and cans, including paint cans, have a circular perimeter. However, lid 10 can have a non-circular perimeter, for example a square or rectangular perimeter or even an irregularly shaped perimeter.

It is to be understood that the term paint encompasses all types of paints, and all types of finishes and liquids which can be applied to a building or to furniture or other items typically coated with a decorative and/or a protective substance and to liquids used with such finishes and liquids. For example, the term paint is meant to encompass stains, oils (such as Danish oil finishes, linseed oil and the like), shellac, varnish, lacquer, resin, paint thinner, turpentine, polyurethanes, and the like which may be available as fluids, gels, powders and the like.

Moreover, lid 10 can be used with containers for all types of products including, but not limited to, food, cosmetics, household cleaning products, personal hygiene products, lubricants, industrial chemicals, gardening products and the like.

Lid 10 includes at least one resiliently expandable opening 16 and/or 18 and/or 20 which, as depicted in a particular embodiment of the present invention, are radial slit groupings. A resiliently expandable opening is an opening which can vary in size depending upon the size of a particular implement, such as paint brush 34, inserted therethrough, but will at least partially return, and preferably will fully return, to an original size when the implement is removed therefrom depending on the elastic deformation characteristics of the selected material. Openings 16, 18 or 20 exert a compressive force on the longitudinal extent of handle 36 of brush 34 which is sufficient to retain the brush 34 in openings 16, 18 or 20. Preferably brush 34 is retained so that some portion of the bristles 38 are held below surface 40 of paint in container 32, thereby keeping the bristles 38 pliable. Most preferably, the brush 34 is retained in openings 16, 18 or 20 so that it will not slip down and bristles 38 will not contact bottom 42 of container 32, whereby bristles 38 can become bent rendering brush 34 less useful or unusable.

In another embodiment, lid 10 can be used to store implements in an empty container. Alternatively, lid 10 can be used to retain a paint brush which has been immersed in paint and/or used in an inverted position and requires draining. Moreover, suspending a brush in a vertical position wherein the bristles are not in contact with any rigid surfaces will tend to cause the bristles to straighten as a result of gravity.

Figure 5:
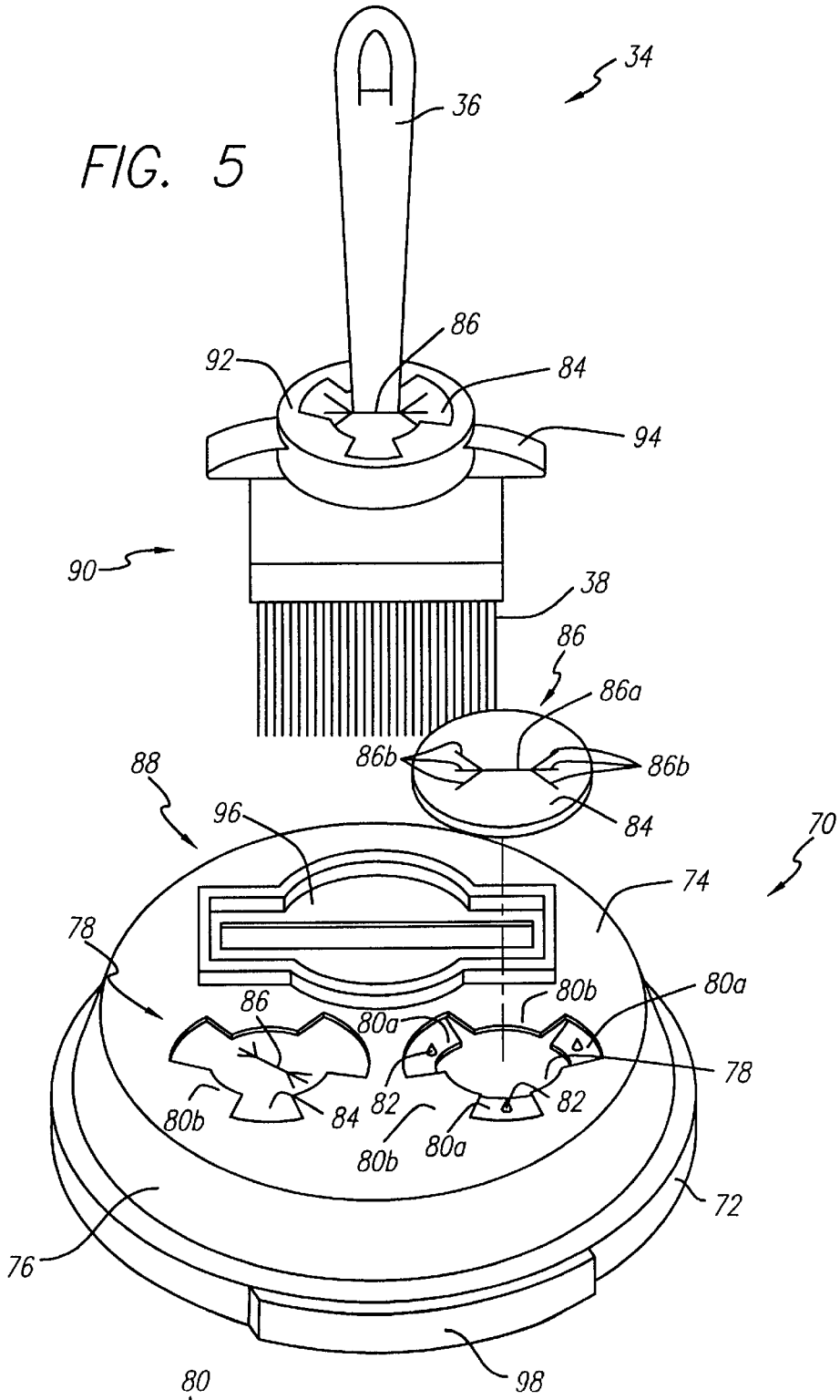
FIG. 5 is an exploded view of a lid and a brush having a brush retention member thereon in accordance with a preferred embodiment of the present invention.

Openings 16,18 and 20 can all be the same size, of different sizes or a combination of the same and different sizes. In one embodiment of the invention, lid 10 includes at least one opening 16. In another embodiment, lid 10 contains at least two openings 16 and 18. Openings 16, 18 and 20 are configured to exert a force on an implement inserted therein, thereby retaining the implement in opening 16 and/or 18 and/or 20 while providing at least some sealing function about the implement. This retaining and sealing function is provided by at least one of openings 16, 18 and 20 without the need for additional means for retaining and sealing the openings. Openings 16, 18 or 20 can comprise an open circular hole of selected diameter, the diameter depending on the size of the implement to be retained therein. Alternatively, openings 16, 18 or 20 can comprise a slit. Also, openings 16, 18 and 20 can comprise a plurality of slits that extend from a central slit (as shown in FIG. 5 as 86) or opening. Openings 16, 18 or 20 include at least two slits, preferably having a common center point 19. Such an arrangement of slits is referred to as a radial slit grouping. Most preferably, the opening includes a number of radially arrayed slits 21*a–f* having a common center point 22. A number of radially arrayed flaps 17*a–h* are displaced by an implement inserted in opening 1 6. The flaps exert a force against the implement which retains the implement therein. The flaps also provide a seal which reduces any evaporation of the contents of the container, so that less evaporation occurs then if flaps 17*a–h* were not provided and so engaged against the implement. When used with products that emit harmful vapors, such as certain solvents, lid 10 can decrease the evaporation of such solvents compared to the use of the solvent in a non-covered lid, and also reduces the amount of thinner required to be used and disposed of. This provides an ecological benefit to the use of lid 10 with such products.

The implements which can be retained or suspended in the openings include but are not limited to, brushes, such as paint brushes, paint rollers, knives, such as putty knives, eating utensils and the like. Openings 16, 18 or 20 can be sized or shaped according to the size of an implement to be retained or suspended therein. As used herein suspended means holding an implement in a substantially upright position such that the implement is not disposed in the container in a uncontrolled manner.

The invention also includes a system which comprises a lid of the present invention and a standard sized can such as a paint can.

The present invention also includes a kit which includes the lids of the present invention provided in a number of sizes which correspond to different size standard containers such as 1 quart, 1 gallon, 2 gallon and 5 gallon paint cans.

Figure 6:
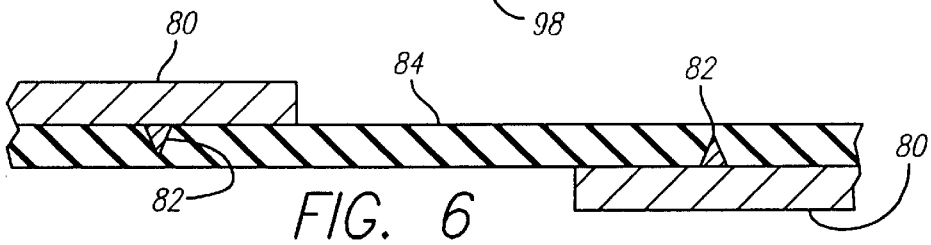
FIG. 6 is a sectional elevation of an upward facing protrusion and a downward facing protrusion each having a spike thereon for securing the seal in place.

Referring to FIGS. 5–6, in another preferred embodiment, a lid 70 includes an integral rim 72, a central portion 74 and an offset portion 76 for vertically offsetting central portion 74 from integral rim 72. That is, substantially planar central portion 74 defines a first vertical height relative to the floor of a container to which the lid 70 is to be affixed. When lid 70 is inverted, central portion 74 defines a second vertical height which is different from the first vertical height. In an alternative embodiment, offset portion 76 can be omitted. Central portion 74 includes at least one opening 78, 88 therein. Different types of openings can be included in the central portion. A first type of opening (first opening) 78 includes a plurality of staggered shut-offs or protrusions 80*a,b*. The protrusions 80*a,b* have at least one spike 82 extending therefrom. In a particular embodiment the first opening 78 includes six protrusions 80*a,b*. Preferably the protrusions 80*a,b* are opposingly staggered as shown in FIG. 5. Three protrusions 80*a* face upward and have a spike 82 extending upward, and three protrusions 80*b* face downward and have a spike 82 extending downward. The upwardly facing protrusions 80*a* are spaced apart vertically from the downwardly facing protrusions 80*b* such that an insert or seal 84 can be disposed therebetween, as shown in FIG. 6. The seal 84 is comprised of a resilient material having a slit, grouping of slits 86 or the like as described above. Preferably, the grouping of slits 86 comprises a central slit 86*a* having a plurality of ancillary slits 86*b* extending angularly from the ends of central slit 86*a*. This type of slit grouping 86 conforms generally to the shape of the handle 36 of most common sized brushes 34 and it will be understood that the material selected for the seal 84 will provide lesser or greater sealing capability. The spikes 82 hold the seal 84 in place. It will also be understood that a plurality of spikes, hooks, barbs or the like can be used to secure seal 84 in place. Any number of protrusions 80*a,b* are within the scope of the present invention.

A second type of opening (second opening) 88 is formed to correspond to a brush retention member 90 as shown in FIG. 5. Retention member 90 includes a lid engagement portion 92 and a brush engagement portion 94. The lid engagement portion 92 has a seal 84 with a slit grouping 86 secured therein. The seal 84 can be secured using protrusions 80 and spikes 82 as described above. The slit grouping 86 can be configured as shown or can be a radial slit grouping as described above. Any slit arrangement for securing a brush handle 36 therein is within the scope of the present invention. The lid engagement portion 92 as illustrated is circular in shape, however, other shapes are within the scope of the present invention. For example, the entire retention member 90 can be formed in an oval or rectangular shape with an opening defined therethrough.

Second opening 88 is preferably rectangular so as to allow a paint brush 34 having a rectangular configuration to fit therethrough. Second opening 88 is preferably surrounded by an indented portion 96, the shape of which corresponds to retention member 90. In operation, when the paint brush 34 is inserted into the second opening 88, the lid engagement portion 92 and brush engagement portion 94 engage the indented portion 96, thereby securing the brush 34 in place in sealing arrangement to form a closed container assembly. In an alternative embodiment, retention member 90 and indented portion 96 can be designed to snap fit together. It will be understood that as a brush is pulled from second opening 88 excess paint on the brush may be removed from the brush 34 by wiping the inner edges of second opening 88.

Lid 70 can be made of plastic, rubber, a combination of both, or lid 70 can be made of plastic and covered partially or entirely with rubber. The protrusions 80 can be formed as a unit with lid 70 or they can be secured within opening 78 by an adhesive or the like. The seal 84 can be secured in opening 78 by adhesives, ultrasonic welding, stitches, rivets, or other forms of securing known to those skilled in the art.

It will be understood, that lid 70 can include any number of first openings 78 and/or second openings 88. Lid 70 can also have a handle 98 affixed thereto. For example, the handle 98 can be affixed to integral rim 72 as shown in FIG. 5.

Figure 7:
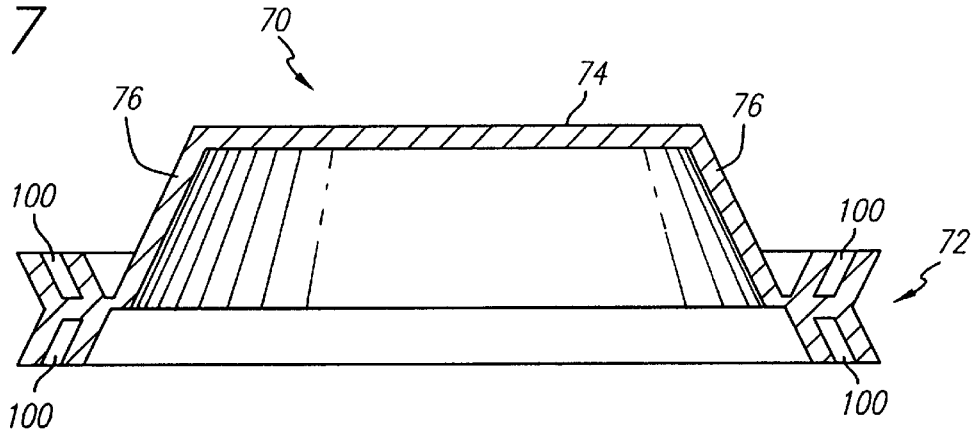
FIG. 7 is a sectional elevation of a lid having two container engaging portions in accordance with another preferred embodiment of the present invention.
Figure 8:
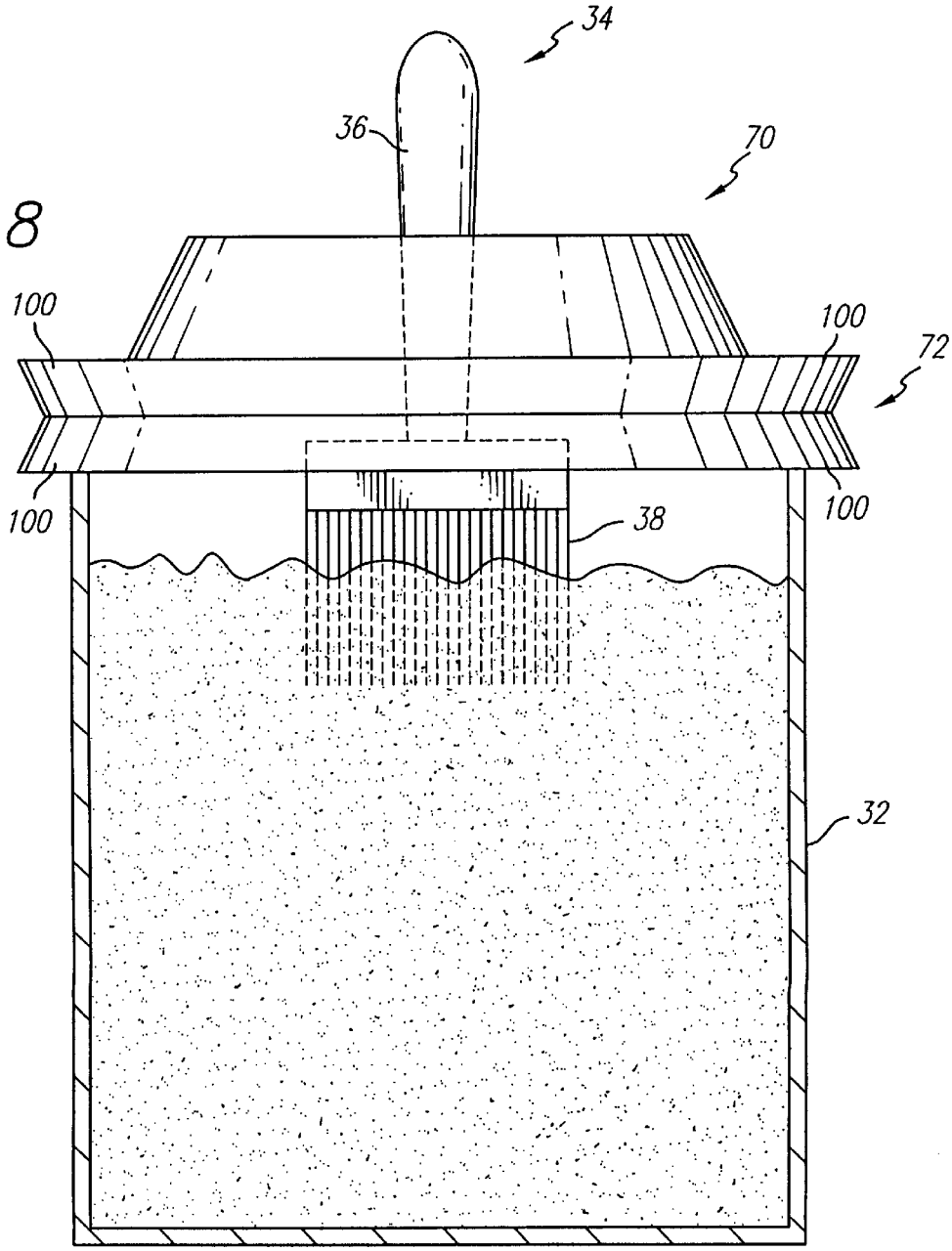
FIG. 8 is a side elevation of the lid of FIG. 6 engaged with a container, showing the container in section.
Figure 9:
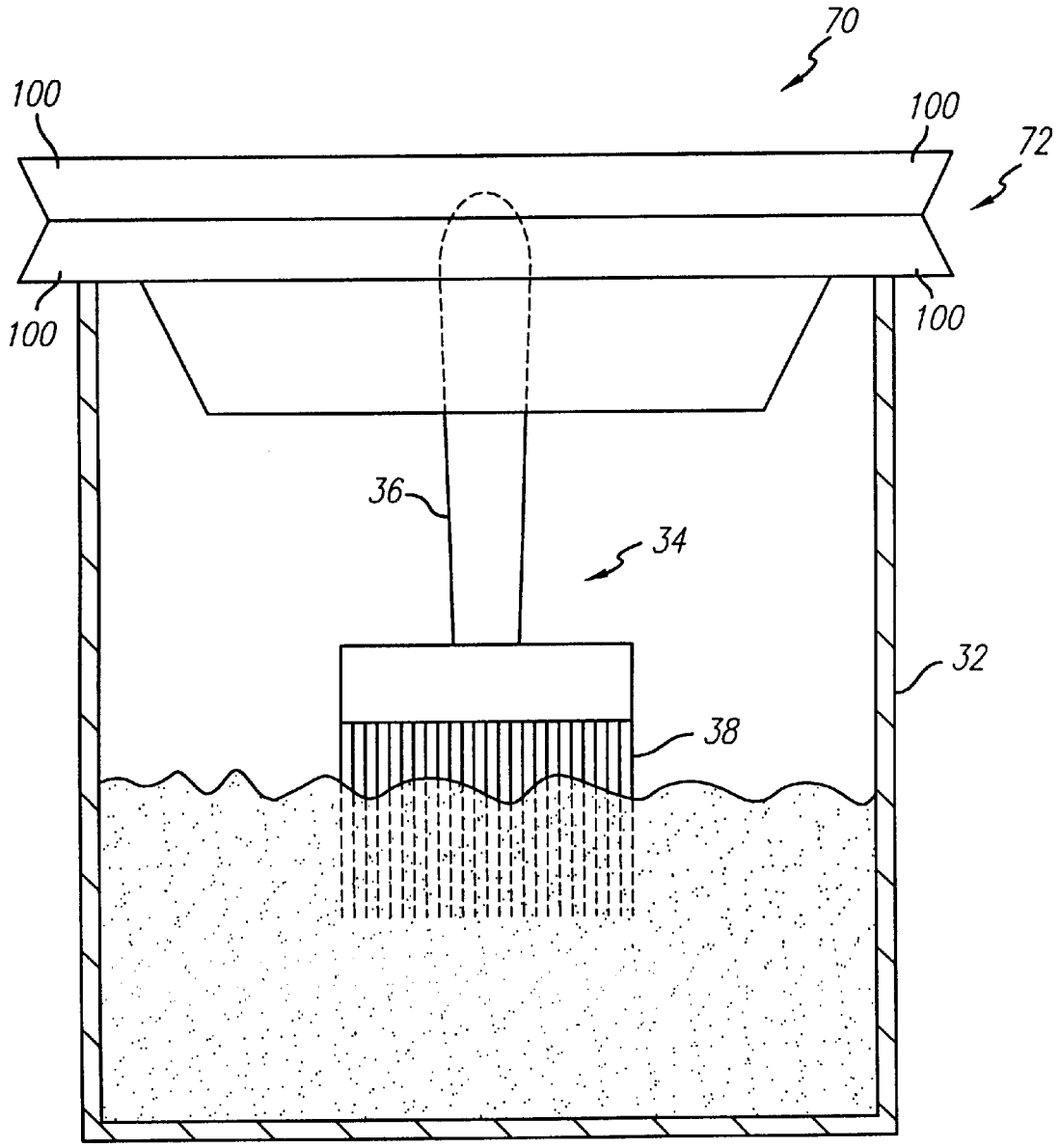
FIG. 9 is a side elevation of the lid of FIG. 6 upside-down and engaged with a container, showing the container in section.

In another embodiment, as shown in FIGS. 7–9, the rim 72 of lid 70 includes two container retention portions 100. Preferably, the container retention portions 100 are opposed. Therefore, the lid 70 can be inverted to accommodate different levels of paint or other material, different size brushes, and reduces the amount of air in the container. As illustrated in FIGS. 8–9 the lid 70 retains the brush at a different height relative to the floor of the container to which the lid 70 is affixed when the lid 70 is right-side up or upside-down, thereby enabling a longitudinal aspect of the bristles 38 to be immersed in the paint no matter how much paint is in the container 32.

In an alternative embodiment, the lid can include a valve, opening or the like for injecting a gas or fluid such as carbon dioxide or nitrogen into the container to purge atmospheric air therein. This prevents the paint or other material from hardening or being otherwise adversely affected.

It will be appreciated that terms such as "upward," "downward," "upside-down," "right-side up" and "vertical" used hereinbelow are merely for ease of description and refer to the orientation of the components as shown in the Figures. It should be understood that any orientation of the lids and the like described herein is within the scope of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A lid for suspending implements in a container for containing a spreadable fluid therein, the lid comprising:

a) a rim snugly engageable with the container, and including a central portion circumscribed by the rim, wherein the central portion has at least one opening defined therein for receiving and suspending the implement, and b) a resilient insert including at least one slit grouping defined therethrough, the slit grouping for receiving and retaining a portion of the implement within the container, wherein the resilient insert is secured in registration with the at least one opening in the central portion, wherein the central portion comprises a plurality of opposed protrusions that extend into the at least one opening, wherein at least one of the plurality of opposed protrusions faces upwards, and wherein at least one of the plurality of opposed protrusions faces downwards, and wherein the resilient insert is disposed between the at least one upward facing protrusion and the at least one downward facing protrusion, whereby the plurality of opposed protrusions secure the resilient insert within the at least one opening.

2. The lid of claim 1 wherein the protrusions are staggeringly opposed.

3. The lid of claim 1 wherein each of the protrusions has an insert engaging surface and wherein at least one spike extends from the insert engaging surface of each protrusion toward a lateral surface of the insert.

4. A kit comprising:

a) a lid for retaining implements in a container for containing a spreadable fluid therein, the lid including a rim snugly engageable with the container, and including a central portion circumscribed by the rim, wherein the central portion has at least one opening defined therein for receiving and suspending the implement, wherein the at least one opening is at least partially surrounded by an indented portion, b) a brush retention member adapted to engage the lid, the brush retention member having an opening defined therethrough, the opening having secured therein a resilient insert having a resiliently expandable opening for receiving a handle of a brush at some portion of the longitudinal extent thereof, wherein the brush retention member is adapted to at least partially correspond to the indented portion, and c) a brush.

5. The kit of claim 4 wherein the lid further includes a resilient insert including at least one slit grouping defined therethrough, the slit grouping for receiving and retaining a portion of an implement within the container at some portion of the longitudinal extent thereof, wherein the resilient insert is secured in registration with the opening in the central portion.

* * * * *